United States Patent [19]

Achard

[11] 4,321,792

[45] Mar. 30, 1982

[54] DEVICE FOR PURIFYING THE EXHAUST GASES OF AN INTERNAL COMBUSTION ENGINE

[75] Inventor: Michel Achard, La Garenne Colombes, France

[73] Assignees: Automobiles Peugeot; Societe Anonyme Automobiles Citroen, both of Paris, France

[21] Appl. No.: 127,067

[22] Filed: Mar. 4, 1980

[30] Foreign Application Priority Data

Mar. 8, 1979 [FR] France ..... 79 05934

[51] Int. Cl.[3] ..... F01N 3/22

[52] U.S. Cl. ..... 60/276; 60/289; 60/301; 60/306

[58] Field of Search ..... 60/276, 290, 289, 306, 60/301

[56] References Cited

U.S. PATENT DOCUMENTS

| | | | |
|---|---|---|---|
| 4,024,706 | 5/1977 | Adawi | 60/274 |
| 4,068,472 | 1/1978 | Takata | 60/290 |
| 4,191,013 | 3/1980 | Katahira | 60/290 |
| 4,231,220 | 11/1980 | Takeda | 60/306 |

FOREIGN PATENT DOCUMENTS

| | | | |
|---|---|---|---|
| 2363726 | 7/1975 | Fed. Rep. of Germany | 60/290 |
| 2814780 | 10/1978 | Fed. Rep. of Germany | 60/290 |

*Primary Examiner*—Douglas Hart

*Attorney, Agent, or Firm*—Burns, Doane, Swecker & Mathis

[57] ABSTRACT

This device results in a very precise metering of the amount of air introduced by a first injector between two catalysts of an exhaust line. To achieve this, first regulating means are regulated so as to deliver a carburetted mixture which is richer than the stoechiometric composition. A second air injector and a second gas analyzer are placed in this order in the exhaust line between a first analyzer and a triple-function catalyst. The second analyzer is associated with second regulating means which control the flow of air in the second injector so as to bring the composition of the exhaust gases to that which would correspond to a richness of the carburetted mixture between the richness regulated by the first regulating means and the stoechiometric composition. Means are provided for maintaining the flows of air of the first and second air injectors proportional to each other.

1 Claim, 1 Drawing Figure

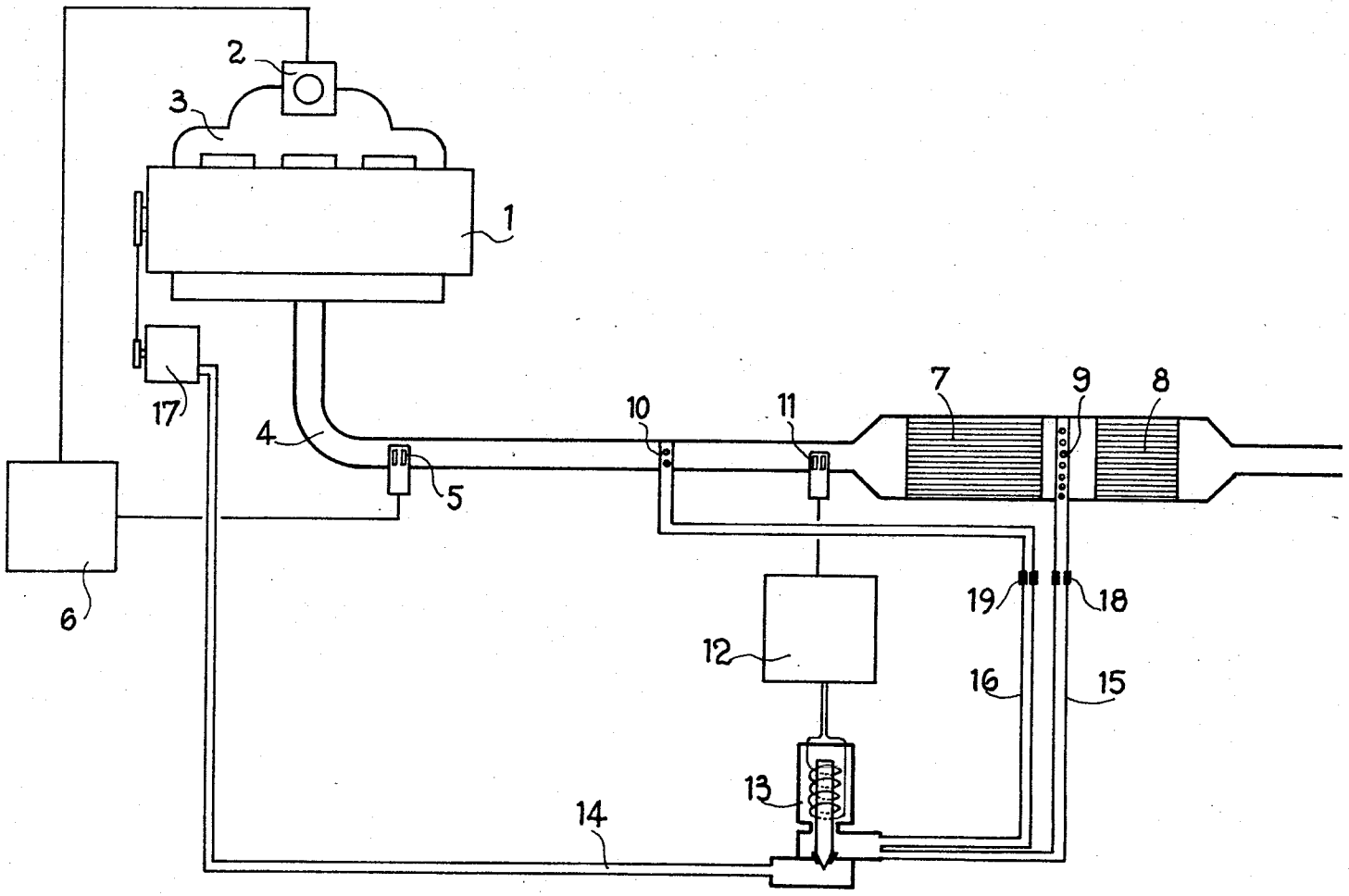
1
2
3
4
5
6
7
8
9
10
11
12
13
14
15
16
17
18
19

DEVICE FOR PURIFYING THE EXHAUST GASES OF AN INTERNAL COMBUSTION ENGINE

DESCRIPTION

The present invention relates to devices for reducing the amount of harmful constituents contained in the exhaust gases of internal combustion engines.

Devices are in particular known which comprise a gas analyser placed in the exhaust manifold and associated with regulating means for maintaining the richness of the carburetted mixture constant, an air injector associated with control means being provided between a catalyst having a triple function and an oxidation catalyst placed in series in the exhaust line.

In the ensuing description it must be understood that the richness is defined by the quotient of the ratio of the mass of fuel to the mass of air in the effective mixture divided by the ratio of the mass of fuel to the mass of air in a stoichiometric mixture.

When the carburetted mixture is very nearly the stoichiometric mixture, the use of a catalyst having three functions produces a very small amount of harmful gases in the exhaust gas. However, in order to ensure that the catalyst has a good performance over a period of time, it is preferable that the composition of the exhaust gases passing therethrough correspond to a richness higher than unity. This is why it is necessary to add, after the three-function catalyst, an oxidation catalyst with an injection of air between the two catalysts.

This injection of air must, in order to be effective, be metered in a very precise manner. Indeed, if the amount of air is insufficient, a certain amount of carbon monoxide and non oxidized unburnt hydrocarbons are expelled to the atmosphere. On the other hand, if there is too much air, nitric oxides and sulphur trioxide are reformed and form sulphuric acid with the humidity of the air.

Now, in certain known devices, the injection of air is regulated for example by means of a needle valve member controlled in accordance with the depression prevailing in the induction pipe, which does not enable the aforementioned condition of precision to be satisfied.

In other prior arrangements (e.g. the West German DT.OS No. 2,329,539 ) an attempt is made to purify the exhaust gases by means of a control of the temperature of operation of the catalytic reactors. However, in this known device, the flow of additional air introduced between the oxidation catalyst and the reducing catalyst respectively, is a function of the speed of rotation of the engine, so that it is impossible to achieve a sufficiently precise metering.

Consequently, an object of the invention is to provide means for achieving a very precise metering of the amount of air injected between the two catalysts provided in the exhaust line.

It is applicable to a device adapted to reduce the amount of polluting gases contained in the exhaust gases of an internal combustion engine, comprising a first gas analyser placed in the exhaust manifold and associated with first regulating means for maintaining the richness of the carburetted mixture constant, a first air injector associated with control means being provided between a triple-function catalyst and an oxidation catalyst which are placed in series in the exhaust line.

In this device, the first regulating means are regulated in order to deliver a carburetted mixture which is richer than the stoichiometric composition, a second air injector and a second gas analyser are placed in this order in the exhaust line between the first analyser and the triple-function catalyst, the second analyser being associated with second regulating means controlling the flow of air in the second injector so as to bring the composition of the exhaust gases to that which would correspond to a richness of the carburetted mixture between the richness regulated by the first regulating means and the stoichiometric composition, and means are provided for maintaining the flow of the first air injector and the flow of the second air injector proportional therebetween.

One embodiment of the invention is described in the ensuing description with reference to the single accompanying FIGURE.

This FIGURE shows diagrammatically an internal combustion engine 1 with a fuel supply device 2, an induction manifold 3 and an exhaust manifold 4.

Disposed in the exhaust manifold 4 is a first gas analyser 5, for example an oxygen detector such as that sold by the firm Robert Bosch under the name "λ" detector. This detector is connected to a first regulator 6 which acts on the supply device 2 so as to maintain the richness of the carburetted mixture sent to the engine constant. An example of such a regulating device may be given by French Pat. No. 2 171 413 (to Robert Bosch GmbH).

Inserted in the exhaust manifold are triple-function catalyst 7 and an oxidation catalyst 8 between which a first air injector 9 is disposed.

Disposed between the first gas analyser 5 and the triple-function catalyst 7 are, in the following order, and in the exhaust manifold, a second air injector 10 and a second gas analyser 11 which may be identical to the first analyser 5.

The analyser 11 is connected to a second regulator 12 which controls an electrically operated valve 13. The latter may, for example, operate at a fixed frequency with a variable opening time so as to constitute the equivalent of an adjustable escape between, on one hand, a pipe 14 and, on the other hand, two pipes 15, 16.

The pipe 14 is connected to an air pump 17 driven by the engine 1. The pipe 15, in which a calibrated jet 18 is disposed, supplies air to the first air injector 9. The pipe 16, in which a calibrated jet 19 is disposed, supplies air to the second air injector 10.

The device just described operates in the following manner:

In accordance with indications furnished by the first gas analyser 5, the first regulator 6 acts in the known manner upon the fuel supply device 2 in such manner that the composition of the gases supplied to the cylinders of the engine corresponds to a richness which is higher than unity, for example 1.04.

In accordance with the indications furnished by the second gas analyser 11, the second regulator acts, in the known manner, upon the valve 13 so that the flow of air introduced by way of the second injector 10 brings the composition of the exhaust gases to that which would be obtained if the carburetted mixture introduced into the engine had a richness between the richness of the mixture actually introduced and the richness of the stoichiometric mixture. This fictitious richness may, for example, be of the order of 1.02, which corresponds to optimum conditions of operation for the triple-function catalyst 7.

The flow of air introduced by way of the air injector 10 is therefore perfectly proportional to the flow of the exhaust gases in the manifold 4. As the flows through the injectors 10 and 9 are proportional to each other, the flow of air introduced by way of the injector 9 is perfectly proportional to the flow of the exhaust gases and exactly corresponds to the needs for guaranteeing a minimum level of harmful constituents after passage through the oxidation catalyst 8.

Consequently, the problem is perfectly solved by simple means without disturbing the conventional exhaust device.

Having now described my invention what I claim as new and desire to secure by Letters Patent is:

1. In a device for purifying the exhaust gases of an internal combustion engine having an exhaust line and a fuel supply device, comprising a first gas analyser within the exhaust line, first regulating means associated with the first gas analyser and the fuel supply device for maintaining constant the richness of the carburetted mixture supplied to the engine, a triple-function catalyst and an oxidation catalyst disposed in series within the exhaust line, the oxidation catalyst being downstream of the triple-function catalyst relative to the flow of the exhaust gases in the exhaust line, a first air injector within the exhaust line between the two catalysts, and control means associated with the first air injector; the improvement comprising a second air injector and a second gas analyser which is located downstream of the second air injector relative to the direction of flow of the exhaust gases within the exhaust line between the first analyser and the triple-function catalyst, second regulating means associated with the second analyser and the second injector for controlling the flow of air in the second injector so as to bring the composition of the exhaust gases to that which would correspond to a richness of the carburetted mixture between the stoichiometric composition and the richness regulated by the first regulating means which last-mentioned richness is regulated to be richer than the stoichiometric composition, and means for maintaining the flows through the first and second air injectors proportional to each other.

* * * * *